US005857744A

United States Patent [19]

LaPointe et al.

[11] Patent Number: 5,857,744

[45] Date of Patent: Jan. 12, 1999

[54] SWIVEL BASE LOCKOUT ASSEMBLY

[75] Inventors: Larry P. LaPointe, Temperance; Jonathan R. Saul, LaSalle; Dennis W. Wright, Monroe, all of Mich.

[73] Assignee: La-Z-Boy Incorporated, Monroe, Mich.

[21] Appl. No.: 950,484

[22] Filed: Oct. 15, 1997

[51] Int. Cl.[6] ..... A47C 1/02

[52] U.S. Cl. ..... 297/344.22; 297/259.2; 297/85; 297/DIG. 7

[58] Field of Search ..... 248/418; 297/344.22, 297/85, DIG. 7, 270.1, 258.1, 344.21, 344.24, 344.26

[56] References Cited

U.S. PATENT DOCUMENTS 3,053,570 9/1962 Fox .
3,141,700 7/1964 Fletcher .
3,190,693 6/1965 Underdown, Sr. .
3,300,244 1/1967 Hughes .
3,547,393 12/1970 Gordin .
3,593,954 7/1971 Ritchie et al. .
3,840,205 10/1974 Faull .
3,881,713 5/1975 Joyce .
3,891,267 6/1975 Taylor .
3,996,834 12/1976 Reynolds .
4,097,016 6/1978 Petrucci .
4,536,029 8/1985 Rogers, Jr. .
4,736,984 4/1988 Tacker .
5,427,433 6/1995 Holobaugh, Jr. .
5,435,622 7/1995 Fay et al. .
5,704,686 1/1998 May .

*Primary Examiner*—Milton Nelson, Jr.
*Attorney, Agent, or Firm*—Harness, Dickey & Pierce, P.L.C.

[57] ABSTRACT

A swivel base lockout assembly for disabling the rotational degree of freedom provided by a swivel plate operably disposed between a stationary base and a chair frame is disclosed. The swivel base lockout assembly includes a threaded fastener extending between the stationary base and a support frame of the chair frame. A spacer bushing is concentrically disposed about the threaded fastener to maintain the substantially parallel orientation of the stationary base and the support frame.

13 Claims, 3 Drawing Sheets

FIG 2
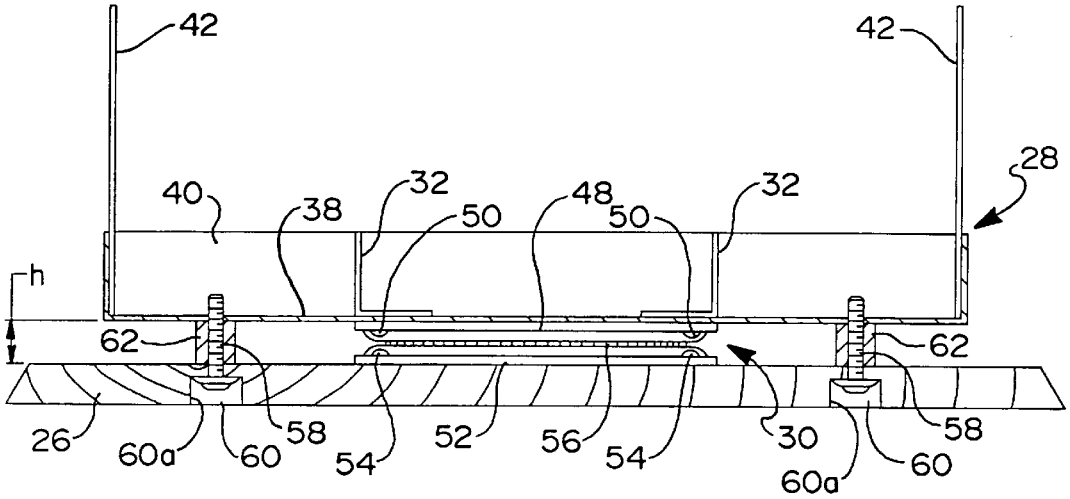
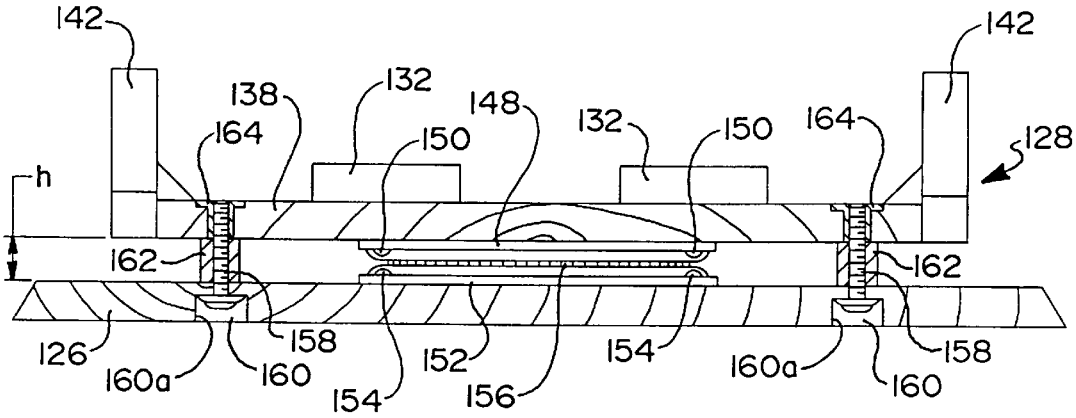
FIG 4

SWIVEL BASE LOCKOUT ASSEMBLY

BACKGROUND OF THE INVENTION

1. Technical Field

The present invention relates to a chair having a swivel base assembly, and more particularly to a swivel base lockout assembly for disabling the rotational degree of freedom provided by a swivel plate located between a base and a chair.

2. Description of Related Art

Swivel chairs are used in a wide variety of environments, and particularly in the homes to provide the convenience of being able to swivel about a stationary base to more easily reach nearby tables, magazine racks, home office or entertainment equipment, or to direct the orientation of the chair to a particular point of focus such as a television, a fireplace or other persons present in the room in which the chair is located. Recognizing the desirability of this feature, chair manufacturers optionally equip different chairs with a swivel mechanism to provide this comfort feature. However, by offering this option, the permutations of chair configurations greatly increase for the chair manufacturers. More specifically, a chair manufacturer may be required to offer a chair design in a stationary base assembly and a swivel base assembly. The addition of these options adds significant cost and complexity to the manufacturing costs of these chairs.

Shipping and handling difficulties present another drawback of chairs equipped with swivel base assemblies. More specifically, a chair equipped with a swivel base assembly is difficult to handle since the base rotates independent from the chair frame. Moreover, chairs which are not packaged within boxes when shipped may shift during shipping causing damage to the chair and its mechanisms or destruction of the chair upholstery.

SUMMARY OF THE INVENTION

In accordance with the principals of the present invention, a swivel base lockout assembly is disclosed which operatively disables the rotational degree of freedom between the stationary base supported on the floor and the chair frame assembly supported above the swivel assembly.

It is another object of the present invention to provide a swivel base lockout assembly which may be enabled or disabled by a retailer or a field service technician to permit or prohibit swivel motion of the chair in accordance with the customer's options.

It is a further object of the present invention to provide a chair having a swivel base assembly which is readily adaptable to a wide range of chair frame designs and styles and which further includes a swivel base assembly which may be readily disabled.

BRIEF DESCRIPTION OF THE DRAWINGS

The various advantages of the present invention will become apparent to one skilled in the art by reading the following specification and subjoined claims and referencing the following drawings in which:

FIG. 2 is a cross-sectional front view of a portion of the swivel base glider chair shown in FIG. 1 illustrating the swivel base lockout assembly;

FIG. 4 is a cross-sectional front view of a portion of the swivel base rocker chair shown in FIG. 3 illustrating the swivel base lockout assembly;

DETAILED DESCRIPTION OF THE PREFERRED EMBODIMENT

Figure 1:
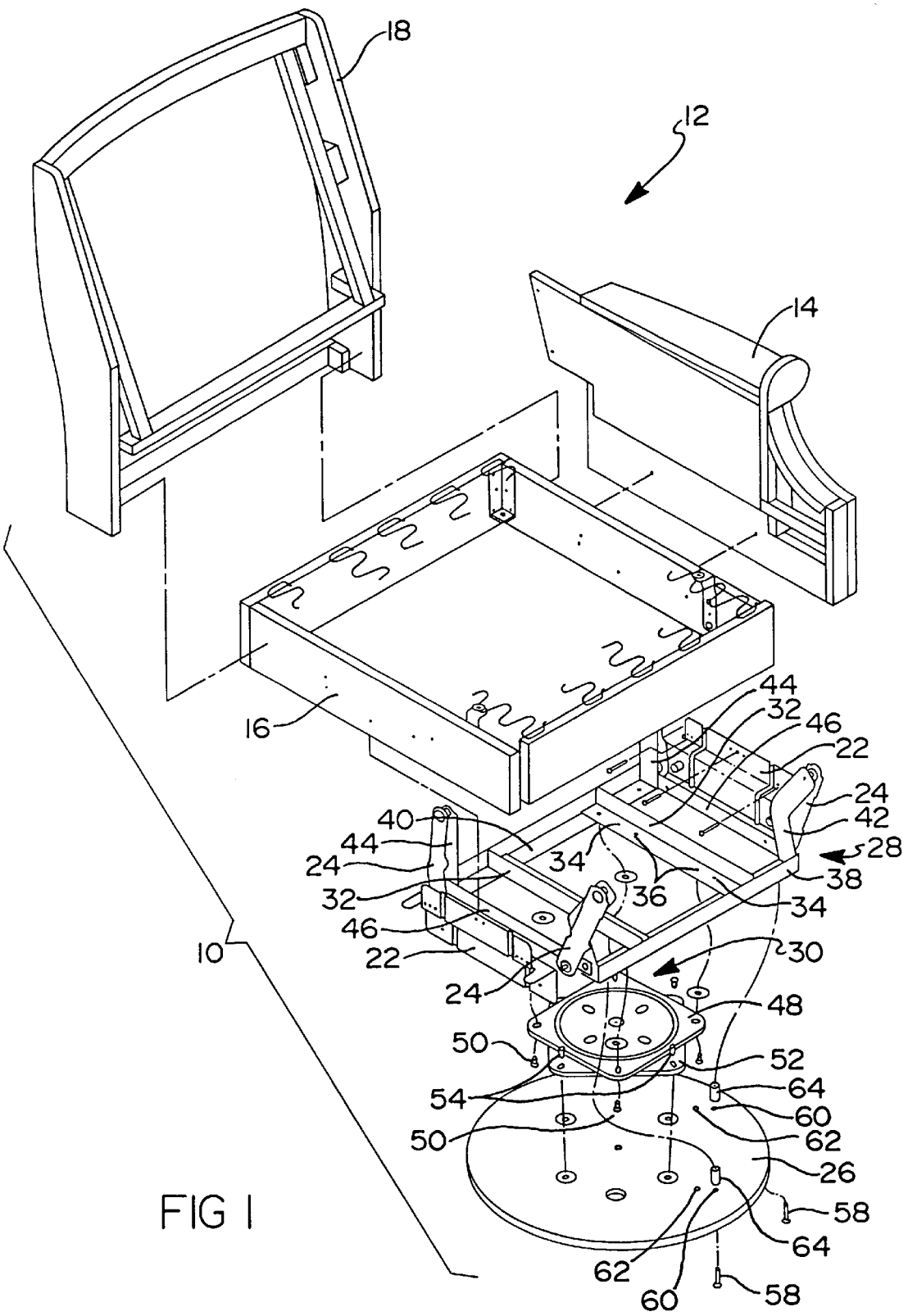
FIG. 1 is simplified exploded perspective view of the present invention incorporated into a swivel base glider chair.

Referring now to FIGS. 1 and 2, a preferred embodiment of the present invention is illustrated in which the swivel base lockout assembly is incorporated into a swivel base glider chair. Glider chair 10 is in the form of an occasional glider chair in which the seat assembly is fixedly secured to the chair frame, and therefore does not recline or tilt relative thereto. Glider chair 10 generally includes chair frame 12 having left and right side walls 14 (the right side wall not being shown) interconnected by seat deck 16 to form a rigid "box-like" chair frame structure. Seat back 18 is coupled to side walls 14 and defines a seating surface in combination with seat deck 16.

Chair frame 12 is operably coupled to glide base assembly 20 by universal glide bracket 22 which attaches directly to seat deck 16. Extended front and rear glide links 24 are pivotally coupled at a first end to universal glide bracket 22 and at a second end to glide base assembly 20 to provide a smooth and relatively flat gliding motion relative to glide base assembly 20.

Glide base assembly 20 supports chair frame 12 above stationary base 26 and includes support frame 28 operably coupled to stationary base 26 through swivel plate assembly 30 to provide a rotational degree of freedom between stationary base 26 and chair frame 12. Support frame 28 includes a pair of inboard longitudinal support members 32 secured to swivel plate assembly 30. As presently preferred, longitudinal support members 32 are provided with a plurality of apertures 34, 36 to permit chair frame 12 to be longitudinally positioned in a plurality of forward/rearward locations with respect to swivel plate assembly 30 for accommodating a variety of chair styles and sizes. Front lateral support member 38 and rear lateral support member 40 are disposed on the ends of inboard longitudinal support members 32 and extend laterally with respect to chair frame 12.

A pair of front glide uprights 42 are rigidly secured to and cantilevered vertically upwardly from the ends of front lateral support member 38 and provide a pivotal attachment location for front glide links 24. Similarly, a pair of rear glide uprights 44 are rigidly secured to and cantilevered vertically upwardly from the ends of rear lateral support member 40 and provide a pivotal attachment location for rear glide links 24. A pair of outboard longitudinal support members 46 are secured to and extend longitudinally between lower portions of front and rear glide uprights 42, 44. As presently preferred, support frame 28 is constructed of simple angular steel members welded into a rigid frame structure with longitudinal support members 46 providing additional rigidity to support frame 28.

Swivel plate assembly 30 is operably disposed between support frame 28 and stationary base 26 to provide swiveling (i.e., rotational) movement therebetween. Swivel plate assembly 30 includes upper plate 48 which is fixedly secured to longitudinal support members 32 by threaded fastener 50, and lower plate 52 which is fixedly secured to stationary base 26 by threaded fasteners 54. A plurality of ball bearings 56 are operably disposed between upper plate 48 and lower plate 52 for permitting support frame 28, and thus chair frame 12, to be swiveled about stationary base 26.

A swivel base lockout assembly is operably disposed between stationary base 26 and support frame 28. More specifically, threaded fastener 58 extends vertically upwardly through bore 60 formed in stationary base 26 and engages a horizontal flange portion of front lateral support member 38. Spacer bushing 64 is concentrically disposed about threaded fastener 58 in between stationary base 26 and front lateral support member 38. As presently preferred, threaded fastener 58 is of a self-tapping variety, such as Rockford HP-5 or an equivalent thereof, to facilitate construction of swivel base lockout assembly. Bore 60 includes counterbore 60*a* extending from a bottom of stationary base 26 for receiving the headed portion of threaded fastener 58 to provide a smooth lower surface thereon. Spacer bushing 64 is dimensioned in accordance with the height h of swivel plate assembly 30 such that support frame 28 remains substantially parallel to stationary base 26. As best seen in FIG. 1, stationary base 26 includes a plurality of bores 60, 62 for receiving threaded fasteners 58 which accommodate the forward/rearward adjustability provided by the interface between support frame 28 and swivel plate assembly 30. As presently preferred, the swivel base lockout assembly of the present invention utilizes two (2) one-quarter inch threaded fasteners for disabling the rotational degree of freedom provided by swivel plate assembly 30 between stationary base 26 and chair frame 12. However, one skilled in the art should readily recognize that the number of lockout members interconnected between stationary base 26 and support frame 28 is dictated by the strength necessary to constrain the rotational degree of freedom therebetween.

While the present invention has been described in connection with an occasional glider chair, one skilled in the art should readily recognize that the present invention could also be adapted for use in other glider chairs which include additional comfort features such as a glider/recliner chair having a tilt control assembly and a leg rest assembly provided therewith such as that disclosed in U.S. application Ser. No. 08/872,540 filed on Jun. 10, 1997, entitled "Glider Chair" which is commonly owned by the assignee of the present invention, and the disclosure of which is expressly incorporated by reference herein.

Figure 3:
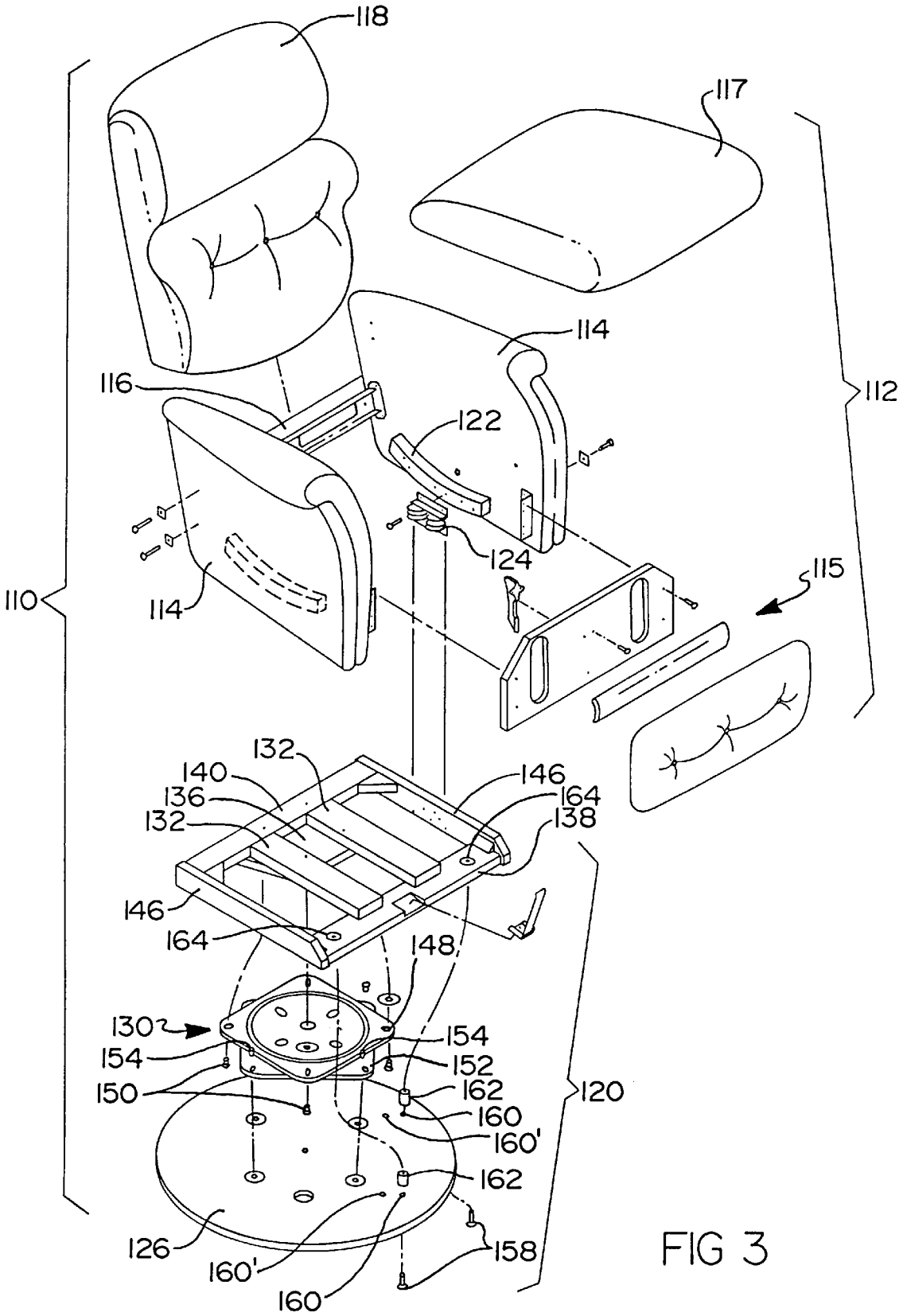
FIG. 3 is simplified exploded perspective view of the present invention incorporate into a swivel base rocker chair.

Referring now to FIGS. 3 and 4, a preferred embodiment of the present invention as utilized in connection with a swivel base rocking chair is illustrated. Rocking chair 110 is in the form of an occasional rocker. Rocking chair 110 generally includes chair frame 112 having left and right side walls 114 interconnected by front cross member 115 and rear cross member 116 to form a rigid "box-like" chair frame structure. Seat 117 and seat back 118 are coupled to side walls 114 to provide a seating surface.

Chair frame 112 is operably coupled to rocker base assembly 120 by rocker blocks 122 which are secured to side walls 114 and rocker spring assemblies 124 (the right rocker spring assembly not being shown) which are secured to rocker blocks 122 and support frame 128. A further description of preferred rocker spring assemblies is the subject of U.S. Pat. No. 5,171,000 issued Dec. 15, 1992, entitled "Adjustable Rocker Spring Apparatus" and U.S. Pat. No. 5,567,009 issued Oct. 22, 1996, entitled "Rocking/Reclining Chair Having Limit Means And Noise Suppression Means" which are commonly owned by the assignee of the present invention and which are expressly incorporated by reference herein. Rocker base assembly 120 supports chair frame 112 above stationary base 126 and includes support frame 128 operably coupled to stationary base 126 through swivel plate assembly 130 to provide a rotational degree of freedom between stationary base 126 and chair frame 112.

Support frame 128 includes a pair of inboard longitudinal support members 132. Front lateral support member 138 and rear lateral support member 140 are disposed on the opposite ends of inboard longitudinal support members 132 and extend laterally with respect to chair frame 112. Swivel mounting member 136 is further secured to inboard longitudinal support members 132 and rear lateral support member 140. A pair of outboard longitudinal support members 146 are secured to and extend longitudinally between front and rear lateral support members 138, 140. As presently preferred, support frame 128 is constructed of wooden members.

Swivel plate assembly 130 is operably disposed between support frame 128 and stationary base 126 to provide swiveling (i.e., rotational) movement therebetween. Swivel plate assembly 130 includes upper plate 148 which is fixedly secured to swivel mounting member 136 by threaded fastener 150, and lower plate 152 which is fixedly secured to stationary base 126 by threaded fasteners 154. A plurality of ball bearings 156 are operably disposed between upper plate 148 and lower plate 152 for permitting support frame 128, and thus chair frame 112, to be swiveled about stationary base 126.

A swivel base lockout assembly is operably disposed between stationary base 126 and support frame 128. More specifically, threaded fastener 158 extends vertically upwardly through bore 160 formed in stationary base 126 and engages threaded T-nuts 164 disposed with apertures formed in front lateral support member 138. Spacer bushing 162 is concentrically disposed about threaded fastener 158 in between stationary base 126 and front lateral support member 138. Bore 160 includes counterbore 160*a* extending from a bottom of stationary base 126 for receiving the headed portion of threaded fastener 158 to provide a smooth lower surface thereon. Spacer bushing 162 is dimensioned in accordance with the height h of swivel plate assembly 30 such that support frame 128 remains substantially parallel to stationary base 126. As presently preferred, the swivel base lockout assembly of the present invention utilizes two (2) one-quarter inch threaded fasteners for disabling the rotational degree of freedom provided by swivel plate assembly 130 between stationary base 126 and chair frame 112.

A further description of a preferred swivel base rocking chair is the subject of U.S. Pat. No. 5,435,622 issued Jul. 25,1995, entitled "Recliner/Rocker Having Preloaded Base Assembly" which is commonly owned by the assignee of the present invention and the disclosure of which is expressly incorporated by reference herein. While the present invention has been described in connection with a swivel base rocking chair, one skilled in the art should readily recognize that the present invention could be readily incorporated into other rocking chairs which include additional comfort features such as a rocker/recliner chair having a reclinable seat assembly and a leg rest assembly provided therewith such as that disclosed in U.S. Pat. No. 5,301,413 issued Apr. 12,1994, entitled "Modular Reclining Chair and Method of Making" which is commonly owned by the assignee of the present invention, and the disclosure of which is expressly incorporated by reference herein.

As will be appreciated from the detailed description set forth above, the drawings and the subjoined claims, the swivel base lockout assembly of the present invention provides means for disabling the rotational degree of freedom provided by a swivel plate between a base and a chair. The present invention has been described in conjunction with a swivel base glider chair and a swivel base rocker chair as exemplary embodiments. While the foregoing discussion discloses and describes these exemplary embodiments, one skilled in the art will readily recognize that the present invention could be adapted for use in a wide range of swivel base chair designs, and that various changes, modifications and adaptations can be made to the present invention without departing from the spirit and scope thereof as defined in the following claims.

What is claimed is:

1. A swivel chair comprising:

a chair having a support frame;

a stationary base;

a swivel plate assembly operably disposed between said support frame and said stationary base to provide a rotational degree of freedom therebetween; and a swivel base lockout assembly including a lockout member operably disposed between said stationary base and said support frame to disable said rotational degree of freedom, said lockout member including a fastener having a head portion received within a bore formed in said stationary base and a shaft portion extending through said stationary base to engage said support frame.

2. The swivel chair of claim 1 wherein said swivel base lockout assembly further comprises a spacer operably disposed between said stationary base and said support frame to maintain a substantially parallel relationship therebetween.

3. The swivel chair of claim 1 further comprising a glider mechanism operably disposed between said chair and said support frame for providing gliding movement of said chair with respect to said support frame.

4. The swivel chair of claim 1 further comprising a rocker mechanism operably disposed between said chair and said support frame for providing rocking movement of said chair with respect to said support frame.

5. The swivel chair of claim 1 wherein said swivel base lockout assembly further comprises a bushing concentrically disposed about said fastener between said stationary base and said support frame to maintain a substantially parallel relationship therebetween.

6. The swivel chair of claim 5 wherein said bushing is a nylon component.

7. The swivel chair of claim 1 wherein said swivel plate assembly is further defined by an upper plate fixedly secured to said support frame, a lower plate fixedly secured to said stationary base and a bearing assembly operably disposed between said upper plate and said lower plate.

8. The swivel chair of claim 7 wherein said bearing assembly is further defined by a plurality of ball bearings operably disposed between said upper plate and said lower plate.

9. The swivel chair of claim 1 wherein said support frame further comprises a pair of longitudinal support members and a front lateral support member secured to a first end of said pair of longitudinal support members, said swivel plate assembly being secured to said pair of longitudinal support members and said fastener engaging said lateral support member.

10. The swivel chair of claim 9 wherein said fastener is a threaded fastener.

11. The swivel chair of claim 10 wherein said lateral support member is a metal component and said fastener is a self-tapping threaded fastener.

12. A swivel-based rocker chair comprising:

a stationary base;

a support frame having a pair of longitudinal support members, a front lateral support member secured to a first end of said pair of longitudinal support members and a swivel mounting member secured to said pair of longitudinal support members;

a chair frame having a pair of side walls interconnected by a front cross member and a rear cross member, a seat and a seat back;

a rocker mechanism including a pair of rocker blocks secured to said pair of side walls and a rocker spring assembly operably disposed between at least one of said pair of rocker blocks and said support frame for providing rocking movement between said chair frame and said support frame;

a swivel plate assembly having an upper plate secured to said swivel mounting member, a lower plate secured to said stationary base and a bearing member operably disposed between said upper plate and said lower plate to provide a rotational degree of freedom between said support frame and said stationary base; and a swivel base lockout assembly operably disposed between said stationary base and said support frame to disable said rotational degree of freedom, said swivel base lockout assembly including a lockout member having a first portion secured to said stationary base and a second portion secured to said front lateral support member, and a spacer operably disposed between said stationary base and said support frame to maintain a substantially parallel relationship therebetween.

13. A swivel-based glider chair comprising:

a stationary base;

a glide base assembly having a pair of longitudinal support members, a front lateral support member secured to a first end of said pair of longitudinal support members, a rear lateral support member secured to a second end of said pair of longitudinal support members, a pair of front uprights secured to said front lateral support member and cantilevered upwardly therefrom and a pair of rear uprights secured to said rear lateral support member and cantilevered upwardly therefrom;

a glider mechanism including a pair of linkages, each linkage having a glide bracket, a front glide link having a first end pivotally connected at an upper pivot to one of said pair of front uprights and a second end pivotally connected at a lower pivot to said glide bracket, and a rear glide link having a first end pivotally connected at an upper pivot to one of said pair of rear uprights and a second end pivotally connected at a lower pivot to said glide bracket; and a chair frame having a pair of side walls interconnected by a seat, said chair frame operably coupled to said glide bracket for permitting gliding movement of said chair frame with respect to said support frame;

a swivel plate assembly having an upper plate secured to said pair of longitudinal support members, a lower plate secured to said stationary base and a bearing member operably disposed between said upper plate and said lower plate to provide a rotational degree of freedom between said support frame and said stationary base; and a swivel base lockout assembly operably disposed between said stationary base and said support frame to disable said rotational degree of freedom, said swivel base lock out assembly including a lockout member having a first portion secured to said stationary base and a second portion secured to said front lateral support member, and a spacer operably disposed between said stationary base and said support frame to maintain a substantially parallel relationship therebetween.

* * * * *